United States Patent [19]

Vanderpool

[11] 4,082,596

[45] Apr. 4, 1978

[54] GARMENT BAG SEALING MACHINE

[76] Inventor: Charles C. Vanderpool, R.D. No. 1, Waverly, N.Y. 14892

[21] Appl. No.: 792,352

[22] Filed: Apr. 29, 1977

[51] Int. Cl.[2] ..... B32B 31/00; B65B 1/04

[52] U.S. Cl. ..... 156/359; 53/76; 53/241

[58] Field of Search ..... 156/359; 53/241, 256, 53/76, 52, 66

[56] References Cited

U.S. PATENT DOCUMENTS

| | | | |
|---|---|---|---|
| 2,639,566 | 5/1953 | Blessing | 53/241 UX |
| 3,284,987 | 11/1966 | Sigmon | 53/76 |
| 3,449,887 | 6/1969 | Abramson | 53/76 |
| 3,755,984 | 9/1973 | Vanderpool | 53/256 X |
| 3,886,713 | 6/1975 | Mitchell et al. | 53/76 X |

*Primary Examiner*—David A. Simmons
*Attorney, Agent, or Firm*—George E. Clark

[57] ABSTRACT

A garment bag sealing machine includes a loading pole for loading a bagged garment onto said machine, the loading pole being movable to transfer the bagged garment to a pick-off unit and lifting cylinder which lifts the bagged garment until a detector, such as a photo electric cell, detects the bottom of the garment at which point a sealing unit, such as a heat sealing unit, is brought to bear upon the bottom portion of the garment bag causing the garment bag to be sealed. The lifting mechanism then carries the bagged garment to a slide rail system which then carries the garment to a packing or removal station.

9 Claims, 11 Drawing Figures

GARMENT BAG SEALING MACHINE

BACKGROUND OF THE INVENTION

1. Field of the invention

The present invention relates to apparatus for handling bagged garments and more particularly, to apparatus for sealing garment bags automatically.

2. Description of Prior Art

In the prior art, there are many devices designed to automaticly or semi-automaticly bag garments with transparent material such as polyethylene. Among these prior art devices is a semi-automatic baging machine which is the subject of U.S. Pat. No. 3,755,984 to Charles Vanderpool the inventor of the present invention. The prior art devices in some cases include means for providing a heat sealing device to seal the top portion of the polyethylene bag in conjunction with apparatus for placing the polyethlene bag over a garment to be covered.

And in one particular prior art device there is also means for sealing a garment bag at both the upper and lower ends. However, the lower end heat sealing device is in a fixed position and is not capable of adjustment relative to the garment being sealed to reduce waste of material for short garments and further cannot handle garments longer than the fixed spacing between the upper heat sealing element and the lower heat sealing element.

SUMMARY OF THE INVENTION

Accordingly, it is an object of the present invention to seal a lower end of a protective garment bag including apparatus which allows an efficient use of bagging material regardless of the length of the garment to be protected.

It is a further object of the present invention to seal a protective garment bag including semi-automatic means for loading a protective bag and garment onto said apparatus, a means for transfering the protected garment from the loading device to a lifting mechanism, a means for detecting the bottom or lower end of a garment to be protected and means for sealing the protective garment bag at a predetermined distance below the bottom or lower end of the garment to be protected.

It is yet another object of the present invention to seal a protective garment bag as above by apparatus which further includes automatic control of each of the mechanisms in a cordinated manner to efficiently handle a large number of garment bags.

It is an advantage of the present invention that the protective garment bag may be efficiently sealed with a minimum waste of bagging material and at a rate which will permit a high volume of articles to be handled in a relatively short time period.

Apparatus according to the present invention includes a garment loading device, a garment lifting mechanism, a garment bag sealing device and a control circuit for controling the sequence of operations of the loading device, lifting mechanism and the sealing device.

These and other objects of the present invention will become immediatly apparant from the following detailed description in conjunction with the accompaning drawing.

DETAILED DESCRIPTION OF A PREFERRED EMBODIMENT OF THE INVENTION

Referring now to FIGS. 1, 2, 3, and 11, the garment bag sealing machine will be described in detail.

Figure 10:
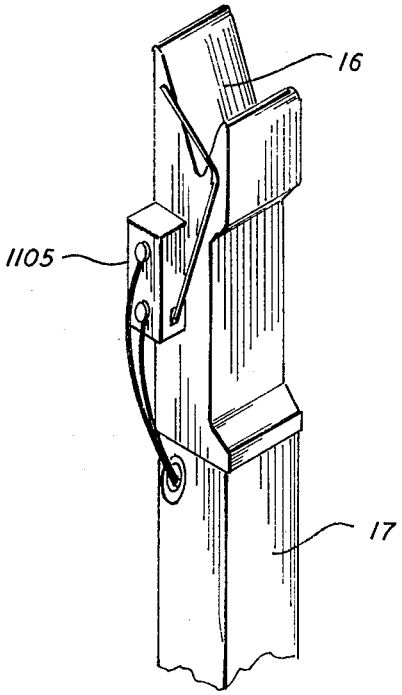
FIG. 10 is an isometric view showing the top portion of the loading device with switch control for initiating operation of the apparatus.

Apparatus 10 is a semi-automatic machine for sealing the end of a protective garment bag 12. Garment bag 12 containing garment 13 is mounted on garment hanger 14. Garment hanger 14 is placed in notch 16 on loading device 17. Referring also to FIG. 10, by loading the garment 13 in notch 16, switch 1105 is closed which initiates operation of the machine. The garment loading device 17 is mounted at a pivot point 18 at the base of the rear portion 11 of machine 10. Garment loading device 17 moves along an arc defined by slots 20 and 22 in rear portion 11 of machine 10. Air cylinder 24 operating under the control of switch 1105 moves loading device 17 from the loading position shown in FIG. 1 to the lifting position shown in FIG. 2. The shaft of cylinder 24 has a clevis attached which is connected to the lower end of loading device 17 through slot 20. Cylinder 24 operates under the control of air value S1 from a supply of pressurized air not shown. Throughout this discription, there will be references to air cylinders and air valves and in each case the air cylinder and air valve will be operated from a source of pressurized air which is commonly available in dry cleaning establishments or similar places of business where garment bagging machines and garment bag sealing machines would be likely to be used.

Figure 2:
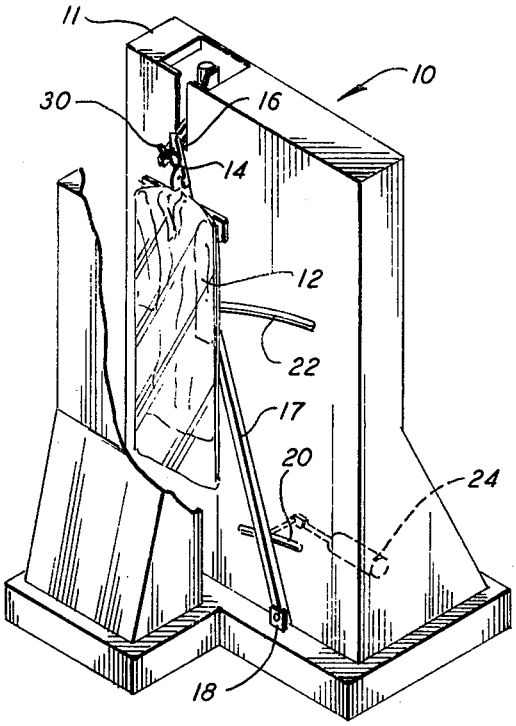
FIG. 2 is an isometric view of apparatus according to the present invention where the garment has been transferred to the lifting position.
Figure 8:
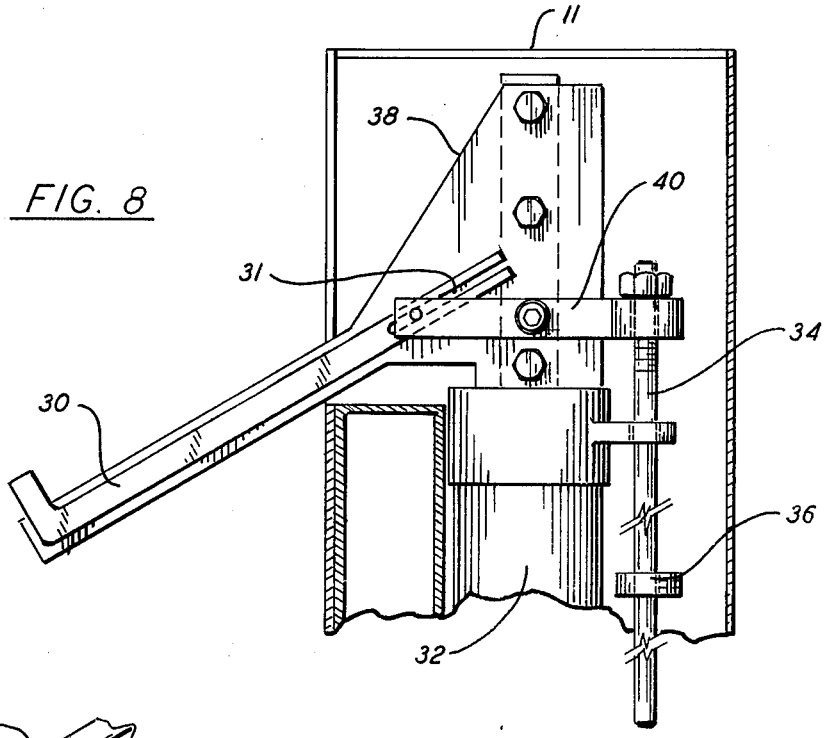
FIG. 8 is a cutaway view showing in details a lifting mechanism according to the present invention.
Figure 9:
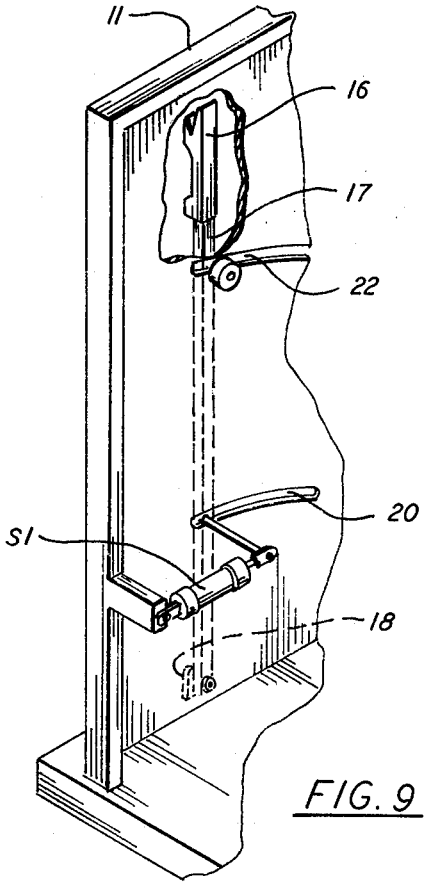
FIG. 9 is a rear cutaway view showing a mechanism for control of a loading device.
Figure 11:
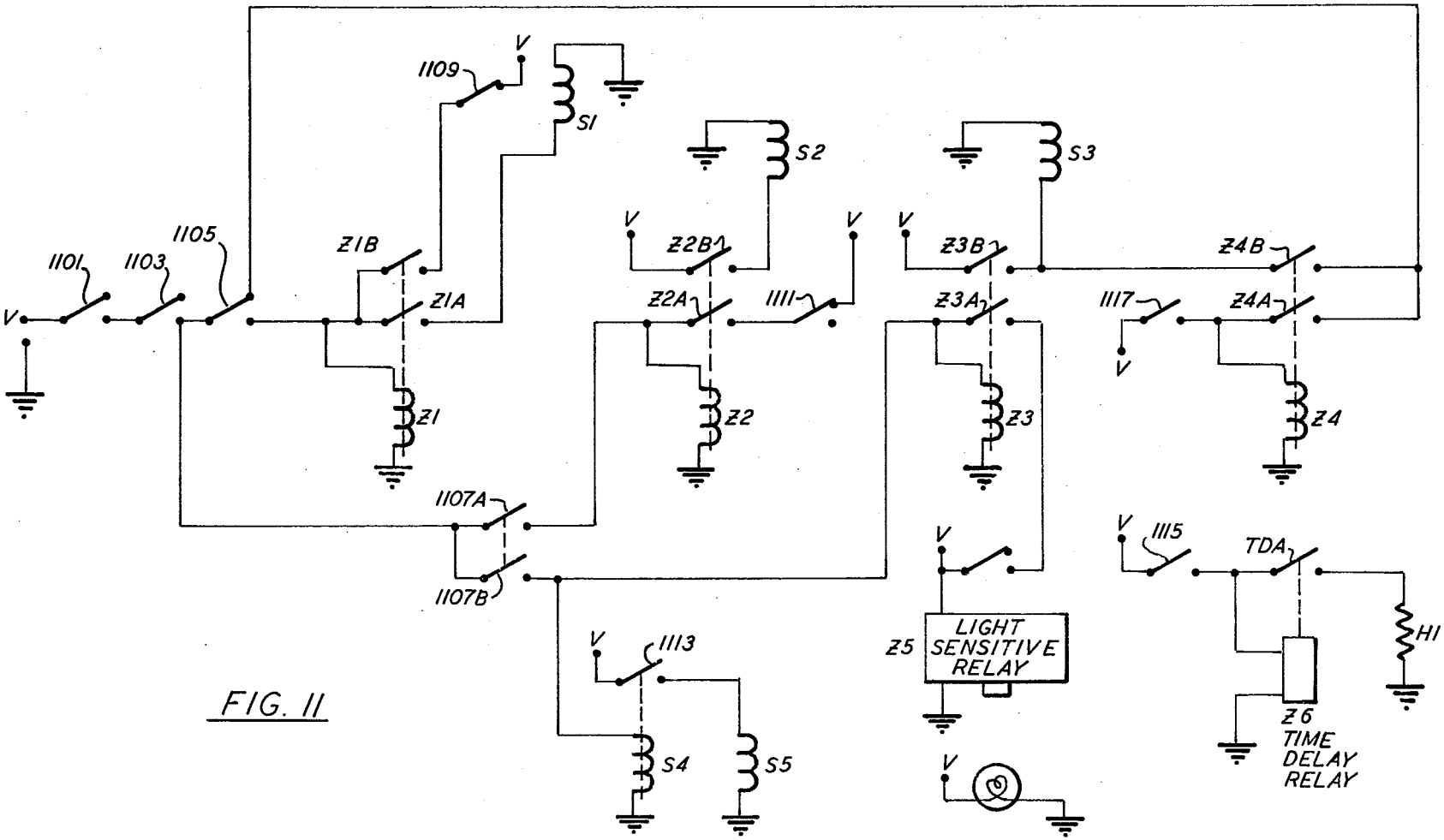
FIG. 11 is a schematic drawing showing a control circuit for controling the sequence of operations of apparatus according to the present invention.

Referring now to FIGS. 2 and 8 as well as FIG. 11, the transfer of the garment 13 and hanger 14 from the loading device 17 to the lifting mechanism 30 will be shown. The motion of loading device 17 to the extreme position mechanically actuates switches 1107A and 1107B which energizes relays Z2 and Z3 causing voltage to be applied to air valves S2 and S3 which operate lifting cylinder 32 (see FIG. 8). The stroke length of lifting cylinder 32 is designed to handle the longest garment and protective garment bag encountered in a drycleaning establishment. As lifting cylinder 32 begins its upward travel, pick-off unit 30 lifts hanger 14 from slot 16 on loading device 17. The weight of the garment causes pick-off device 30 to slide along slot 31 a few inches and rest against the stop latch at the rear of pick-off unit 30. This clears the bagged garment from the loading device 17. Lifting cylinder 32 continues to travel upward and the loading device 17 returns to original position due to a return spring connected to air cylinder 24. Although the loading device has been shown as a pivotally mounted pole arrangement, other mechanisms could be used to accomplish the same function including a horizonaly operated loading mechanism under the control of an air cylinder to move the bagged garment 13 from a loading position to a position for pick-off by pick-off unit 30.

Referring now to FIGS. 3, 4, 6, 7, and 11, a heat sealing mechanism will be described. As lifting cylinder 32 lifts the bagged garment 13 upward, light sensitive relay Z5 senses the bottom of the garment 13 within bag 12. Heat sealing device H1 is mounted in a postion to seal bag 12 at a predetermined distance below the bottom of garment 13. Heat sealing device H1 operated under the control of light sensitive relay Z5. When light sensitive relay Z5 is actuated by light passing through the clear plastic polyethylene protective bag 12, solenoid S4 is actuated closing switch 1113 and energizing air valve S5 which operated the heat seal swing bar mechanism. As air valve S5 is actuated, heating sealing device H1 is moved in contact with the polyethylene bagging material. When the heat sealing unit has reached the end of its travel, switch 1115 is mechanically actuated causing time delay relay Z6 to become energized closing contracts TDA and supplying a voltage to heat sealing element H1. Heat will be applied to the bagging material 12 by H1 for a predetermined time under the control of time delay relay Z6.

When the time delay relay Z6 opens switch TDA, heat sealing unit H1 is turned off and the swing bar unit retracts to the original position as air valve S5 is closed. As swing bar unit arrives at the original position, switch 1117 is mechanically actuated momentarily which energizes relay Z4 closing relay contact Z4A and Z4B. Contacts Z4B provide a voltage to air cylinder S3 which drives lifting cylinder to its maximum vertical position. When lifting cylinder 32 reaches its maximum vertical position, the hanger stop latch 40 will be forced downward by a mechanical stop 36 coming in contact with stop plate 42. At this point, garment pick-off unit 30 moves downward allowing the garment to slide down off the end of the pick-off unit onto a downwardly slanted sliderail system for sorting, loading or other operations.

Figure 1:
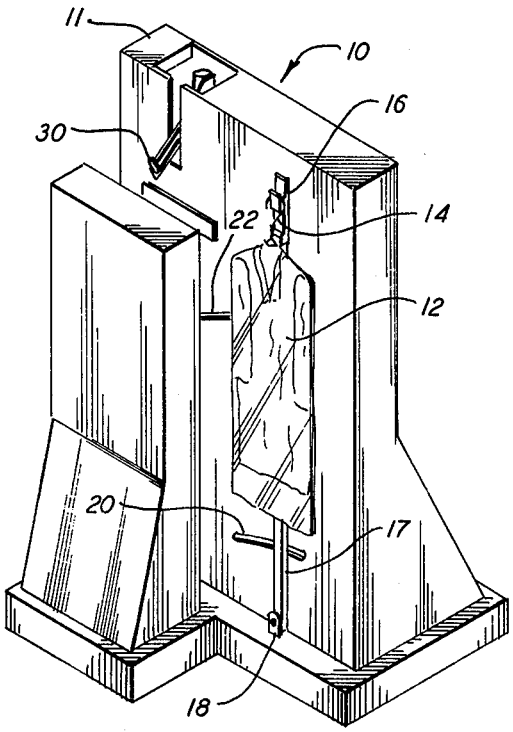
FIG. 1 is an isometric view of apparatus according to the present invention with a garment in the initial loading position.
Figure 3:
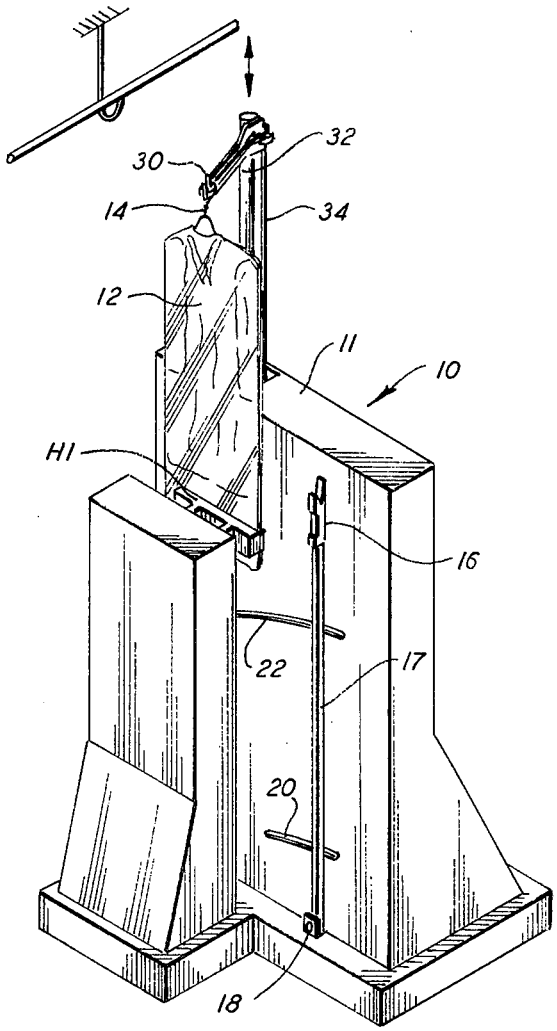
FIG. 3 is an isometric view of apparatus according to the present invention where the garment and protective bag to be sealed have been lifted to the sealing position.
Figure 4:
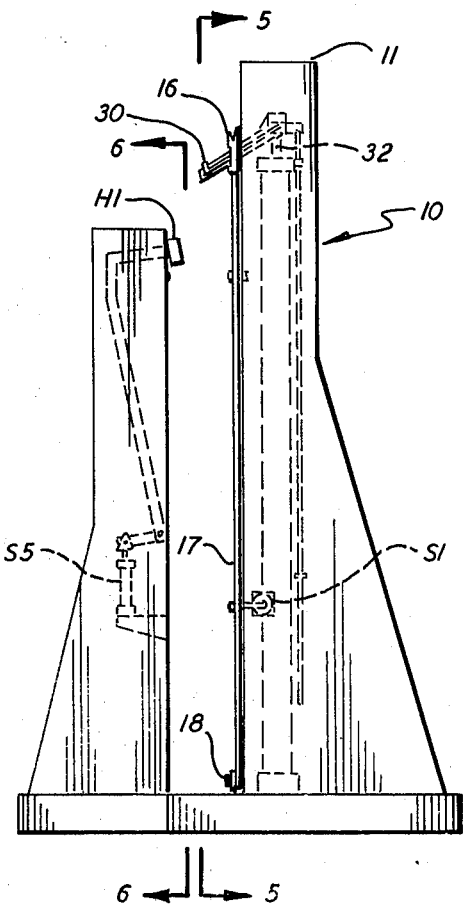
FIG. 4 is a side view of apparatus according to the present invention.
Figure 5:
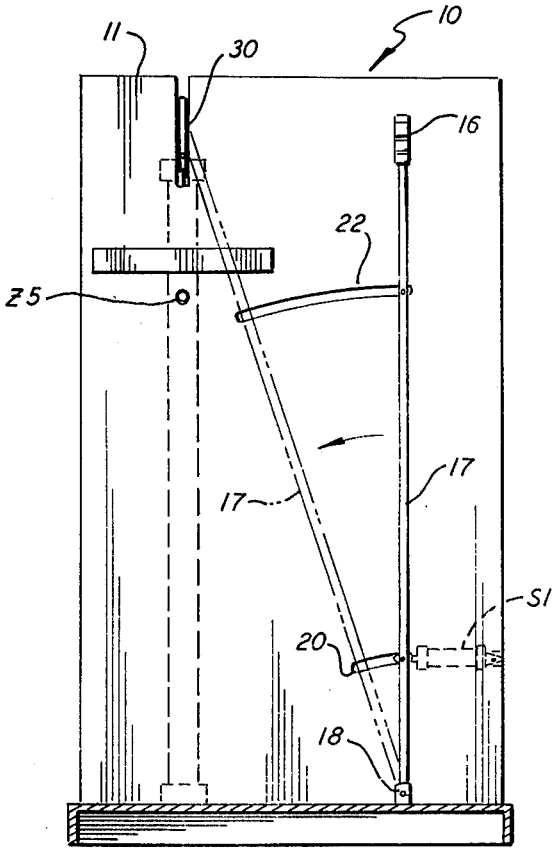
FIG. 5 is a cutaway view of the loading and lifting mechanism according to the present invention.
Figure 6:
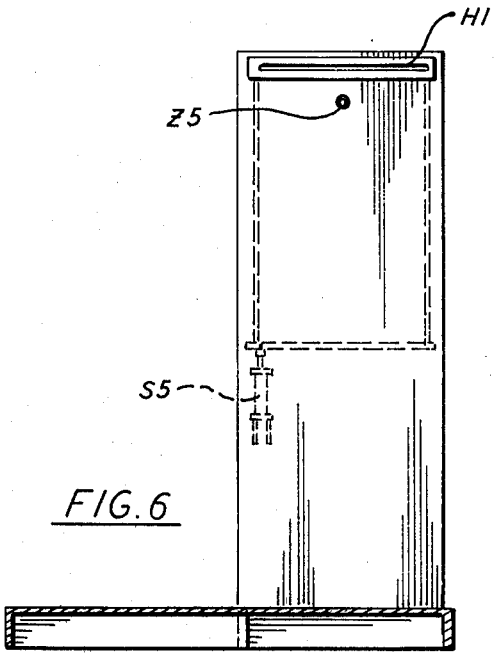
FIG. 6 is a cutaway view showing the sealing and control elements for controlling said sealing device.
Figure 7:
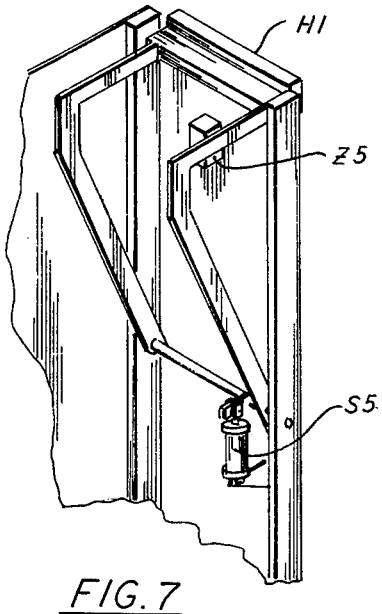
FIG. 7 is an isometric view showing the details of a mechanism for operating the sealing device.

At this point in the operation of apparatus 10, switch 1111 becomes mechanically actuated which breaks the holding circuit for relay Z2. This opens the circuit to air valve S2 causing the lifting cylinder 32 to return to its original retracted position. At this point, one cycle of apparatus according to present invention has been completed. Although a particular embodiment of the invention has been described, there are many variations and implimentations of each of the functions described both mechanical and electrical to achieve the desired result. One example of such alternative was previously mentioned with regard to the loading device 17 being mounted in a horizontal slot move the bagged garment from a loading position to a pick-off position rather than through an arc as shown in FIGS. 1, 2, and 3. Another alternative is the replacement of the light sensitive relay with a electrical conductor wiper arm which would make contact and close a circuit when the garment bag 12 had been lifted past a predetermined point. Also, although the control circuit has been shown as a combination of relays, air values and soleniods, there are many alternatives including the use of solid state components which could be substituted without detracting from the spirit or scope of the invention.

Although a prefered embodiment of the invention has been described it will be apparent to those skilled in the art that there are many variations and modifications which may be made without departing from the spirit or scope of the invention. Therefore, the invention is not to be limited by the specific disclosure of a prefered embodiment herein but only by the appended claims.

What is claimed is:

1. Apparatus for sealing a garment bag, comprising:
means for loading a hanger mounted garment onto said apparatus;
means to support said hanger mounted garment in a vertical orientation on said apparatus;
means connected to and responsive to said loading means for moving said hanger mounted bagged garment to a predetermined position relative to a sealing means; and
a sealing means operated in cooperation with said moving means and said supporting means and for sealing said bag covering said garment at a position on said bag determined by said garment contained therein.

2. Apparatus according to claim 1 further comprising means for removing said bagged garment from said apparatus at the completion of a sealing operation.

3. Apparatus according to claim 1 wherein said bag is comprised of polyethylene or other heat sealable material.

4. Apparatus according to claim 3 wherein said sealing means is a heat sealing device.

5. Apparatus according to claim 4 further comprising:
means for controlling the time period during which said heat sealing device is applied to said bag to achieve a satisfactory seal.

6. Apparatus according to claim 1 further comprising detecting means for detecting a predetermined characteristic of said bagged garment.

7. Apparatus according to claim 6 wherein said predetermined characteristic is a horizontal edge of said garment at a vertical extremity of said garment.

8. Apparatus according to claim 7 wherein said horizontal edge of said garment is a bottom of said garment.

9. Apparatus according to claim 1 further comprising control circuit means for controlling the operation of each of said means of said apparatus.

* * * * *